US008235032B2

(12) United States Patent
Kang

(10) Patent No.: US 8,235,032 B2
(45) Date of Patent: Aug. 7, 2012

(54) APPARATUS FOR CUTTING AND PROCESSING V-GROOVES

(76) Inventor: Hee Chang Kang, Cheongwon-gun (KR)

( * ) Notice: Subject to any disclaimer, the term of this patent is extended or adjusted under 35 U.S.C. 154(b) by 0 days.

(21) Appl. No.: 13/094,801

(22) Filed: Apr. 26, 2011

(65) Prior Publication Data

US 2011/0303209 A1 Dec. 15, 2011

(30) Foreign Application Priority Data

Jun. 9, 2010 (KR) ..... 10-2010-0054423

(51) Int. Cl.
*B28D 1/04* (2006.01)

(52) U.S. Cl. ..... 125/13.01; 125/13.02; 125/15; 451/65

(58) Field of Classification Search ..... 125/13.01, 125/13.02, 15; 451/65, 11; 83/72, 171
See application file for complete search history.

(56) References Cited

U.S. PATENT DOCUMENTS

| | | | | | |
|---|---|---|---|---|---|
| 390,034 | A * | 9/1888 | Peckover | 125/13.01 |
| 1,327,923 | A * | 1/1920 | Phillips | 125/13.01 |
| 2,382,257 | A * | 8/1945 | Ramsay | 451/41 |
| 4,131,103 | A * | 12/1978 | Ishizuka | 125/13.01 |
| 5,056,272 | A * | 10/1991 | Battaglia | 451/41 |
| 5,078,559 | A | 1/1992 | Abe et al. | |
| 5,409,416 | A * | 4/1995 | Eichhorn et al. | 451/41 |
| 5,811,173 | A * | 9/1998 | Eichhorn et al. | 428/167 |
| 6,792,934 | B2 * | 9/2004 | Benyovits | 125/12 |
| 7,018,270 | B2 * | 3/2006 | Peng et al. | 451/5 |
| 7,686,007 | B2 * | 3/2010 | Gifford et al. | 125/35 |
| 8,100,740 | B2 * | 1/2012 | Schlough et al. | 451/5 |

FOREIGN PATENT DOCUMENTS

| | | | |
|---|---|---|---|
| KR | 20-2000-0017667 | U | 10/2000 |
| KR | 1020090005463 | A | 1/2009 |
| KR | 1020090130444 | A | 12/2009 |

* cited by examiner

*Primary Examiner* — George Nguyen
(74) *Attorney, Agent, or Firm* — Sherr & Vaughn, PLLC

(57) ABSTRACT

Provided is a V-groove processing apparatus for cutting and V-groove processing. The V-groove processing apparatus includes a processing unit for processing V-grooves in an engineered stone raw plate fixed on a table while being transferred by a transfer unit. Here, the processing unit includes a circular saw blade disposed at a front of a cutting panel to cut the engineered stone raw plate, one or more cutters disposed on a front of a cutter housing to form a V-groove inside a cut surface, a first rise and fall unit transferring the circular saw blade to a cutting location during the cutting of the engineered stone raw plate and restoring the circular saw blade to an original place after the cutting of the engineered stone raw plate, and a second rise and fall unit transferring the circular saw blade and the cutters to a V-groove forming location during the formation of the V-groove and restoring the circular saw blade and the cutters to original places after the formation of the V-groove.

3 Claims, 11 Drawing Sheets

APPARATUS FOR CUTTING AND PROCESSING V-GROOVES

CROSS-REFERENCE TO RELATED APPLICATIONS

This U.S. non-provisional patent application claims priority under 35 U.S.C. §119 of Korean Patent Application No. 10-2010-0054423, filed on Jun. 9, 2010, the entire contents of which are hereby incorporated by reference.

BACKGROUND

The present disclosure herein relates to an apparatus for cutting and processing V-grooves, and more particularly, to an apparatus for cutting and processing V-grooves in which both cutting and processing of V-grooves are performed.

Engineered stone is widely used as the top plates of kitchen sinks, bathroom sinks, tables, counter desks, windowsills, reception desks, furniture, and the like due to its excellent formability.

As shown in FIG. 1, a sink unit may include a storage closet 20 for storing articles, an engineered stone top plate 10 disposed on the storage closet 20 for cooking works, and a sink 30 seated on a hole of the top plate.

The top plate 10 includes a flat part 11 serving as a countertop, a front part 12 at the front of the flat part 11, a rear part 13 at the rear of the flat part 11, and a side part 14. In order to manufacture the top plate 1, as shown in FIG. 2A, a scratch-protective film 1*a* is first detached from a glossy surface of the engineered stone raw plate 1. As shown in FIG. 2B, an adhesive tape for preventing each part of the countertop from being separated from each other is attached to the opposite surface of a portion in which V-grooves are to be formed. As shown in FIG. 2C, V-grooves are formed at the boundaries between the flat part 11, the front part 12, the rear part 13, and the side part 14. Thus, when the formation of the V-grooves is completed, an adhesive are coated on a processed surface of the V-grooves. Thereafter, as shown in FIG. 2D, the engineered stone raw plate 1 is folded into the shape of the top plate 10, and the adhesive is dried. When the adhesive is completely dried, the adhesive tape 1*b* is detached. As shown in FIG. 2E, projecting edges and adhesives are processed through round-cutting and sanding. Finally, the glossy surface damaged by the above process is polished to recover gloss, and the process for manufacturing the top plate is completed.

The V-groove processing is performed by a typical V-groove processing apparatus. The V-groove processing apparatus may be equipped with one or more cutters for cutting V-grooves. The V-groove processing apparatus may form V-grooves by moving the cutter while the engineer stone plate 1 is being fixed, or may form V-grooves by moving the engineer stone plate 1 while the cutter is being fixed.

SUMMARY

The present disclosure may provide an apparatus for cutting V-grooves, which can facilitate the manufacture of an engineered stone top plate by replacing a typical V-groove processing apparatus having a limitation in that an engineered stone raw plate has to be cut using a typical cutter and moved to a V-groove processing apparatus to undergo a further process.

The present disclosure may also provide an apparatus for cutting V-grooves, which can prevent occurrence of negligent accident and increase of labor cost that are caused because a heavy engineer stone plate has to be moved from a cutter to a V-groove processing apparatus.

The present disclosure may also provide an apparatus for cutting V-grooves, which can overcome a limitation in that a location of a V-groove to be formed has to be again set after an engineer stone plate is moved to a V-groove processing apparatus.

Embodiments of the present invention provide V-groove processing apparatuses for cutting and V-groove processing, including a processing unit for processing V-grooves in an engineered stone raw plate fixed on a table while being transferred by a transfer unit, wherein: the processing unit includes: a circular saw blade disposed at a front of a cutting panel to cut the engineered stone raw plate; one or more cutters disposed on a front of a cutter housing to form a V-groove inside a cut surface; a first rise and fall unit transferring the circular saw blade to a cutting location during the cutting of the engineered stone raw plate and restoring the circular saw blade to an original place after the cutting of the engineered stone raw plate; and a second rise and fall unit transferring the circular saw blade and the cutters to a V-groove forming location during the formation of the V-groove and restoring the circular saw blade and the cutters to original places after the formation of the V-groove; the first rise and fall unit includes: a first screw rod vertically disposed at one side of the cutter housing adjacent to the cutting panel; a first rise and fall motor fixedly disposed at one side of the cutter housing so as not to be interfered with the first screw rod and the cutting panel; a first chain connecting the first screw rod and the first rise and fall motor; and a first screw nut block mounted on one end of the cutting panel adjacent to the first screw rod and penetrated by the first screw rod; and the second rise and fall unit includes: a second rise and fall motor mounted on an upper portion of a column vertically extending from an upper surface of the cutter housing; a second screw rod including one end thereof connected to the second rise and fall motor and the other end thereof connected to an upper portion of the cutter housing along the column; and a second screw block disposed at a rear side of the column and penetrated by the second screw rod.

In some embodiments, the circular saw blade and the cutters may be connected to a cutting motor at a rear side of the cutting panel and a V-groove forming motor at a rear side of the cutting housing to rotate.

In other embodiments, the first screw rod and the first rise and fall motor may be mounted with a first sprocket so as to be connected by the first chain, and the first rise and fall motor may be mounted with a second sprocket.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF THE EMBODIMENTS

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Hereinafter, V-groove cutting and processing apparatuses according to exemplary embodiments of the present invention will be described in detail with reference to the accompanying drawings.

Figure 3:
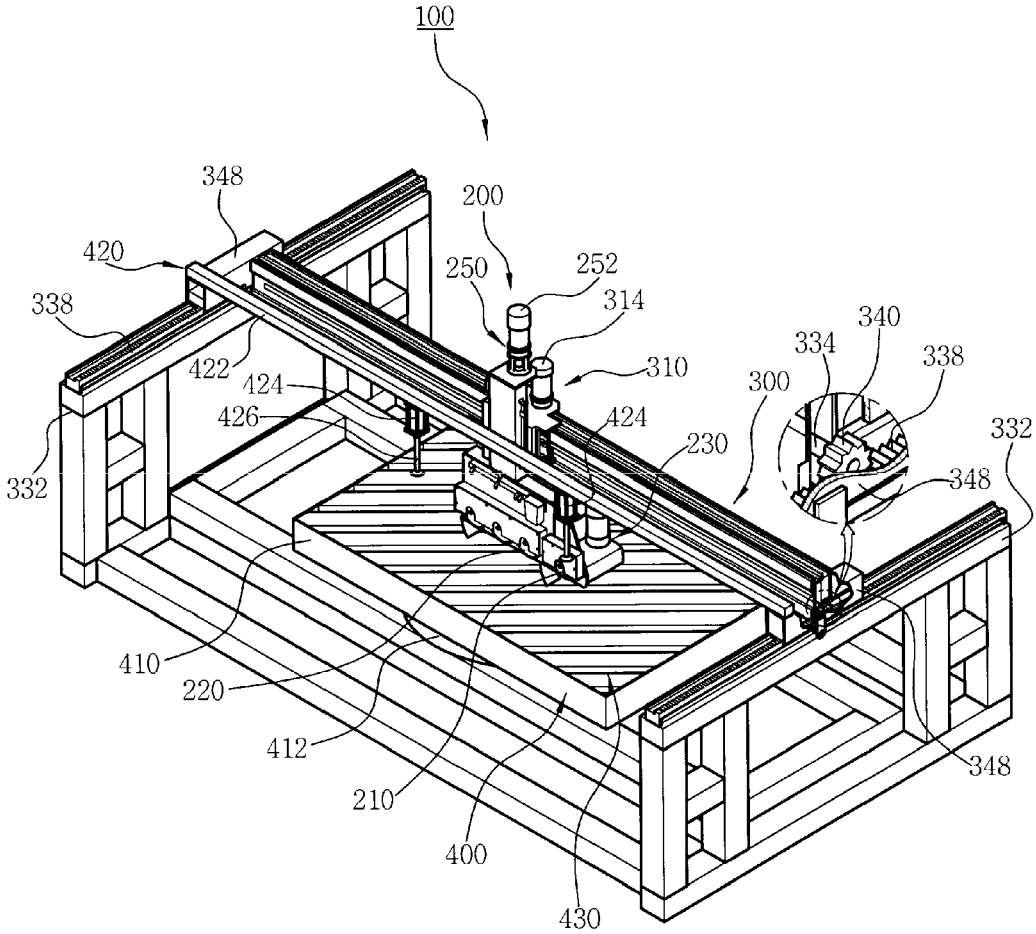
FIG. 3 is a perspective view illustrating a V-groove cutting and processing apparatus according to an embodiment of the present invention.

FIG. 3 is a perspective view illustrating a V-groove cutting and processing apparatus according to an embodiment of the present invention.

Figure 1:
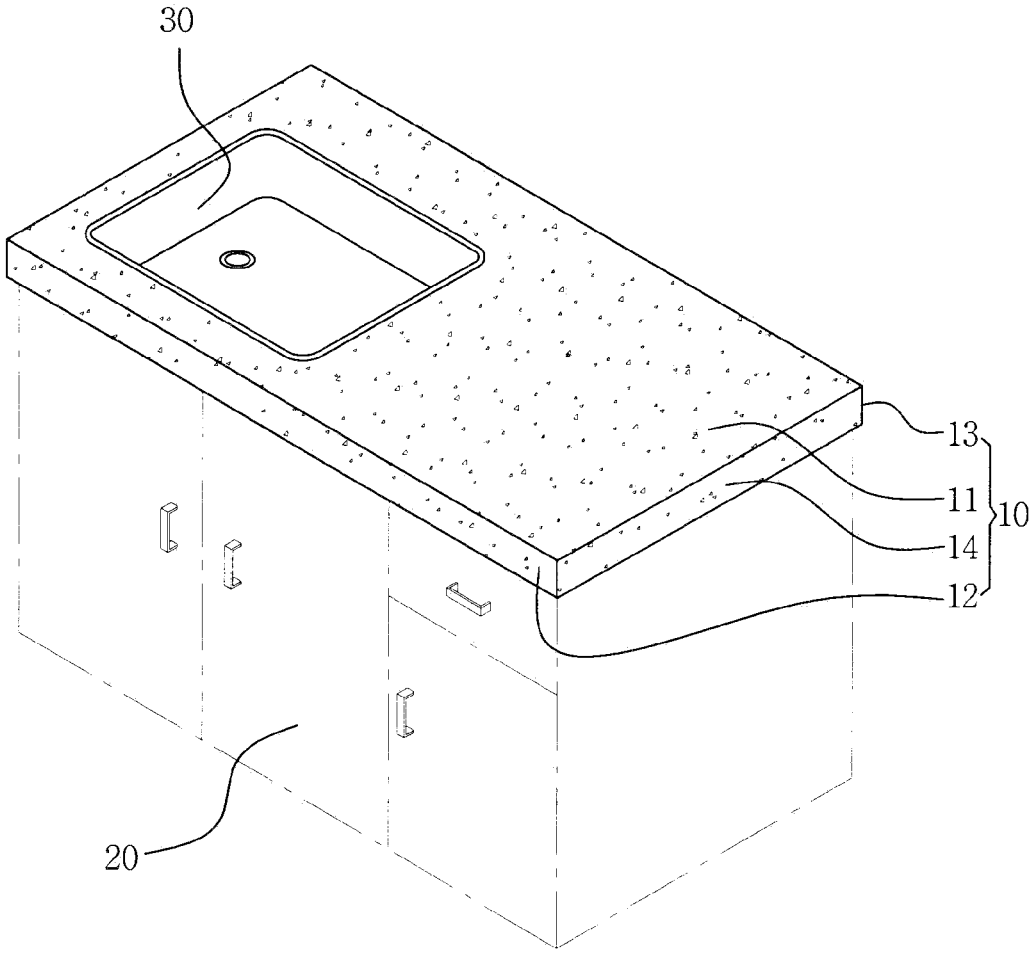
FIG. 1 is a view illustrating a typical sink unit using an engineered stone top plate.
Figure 2A:
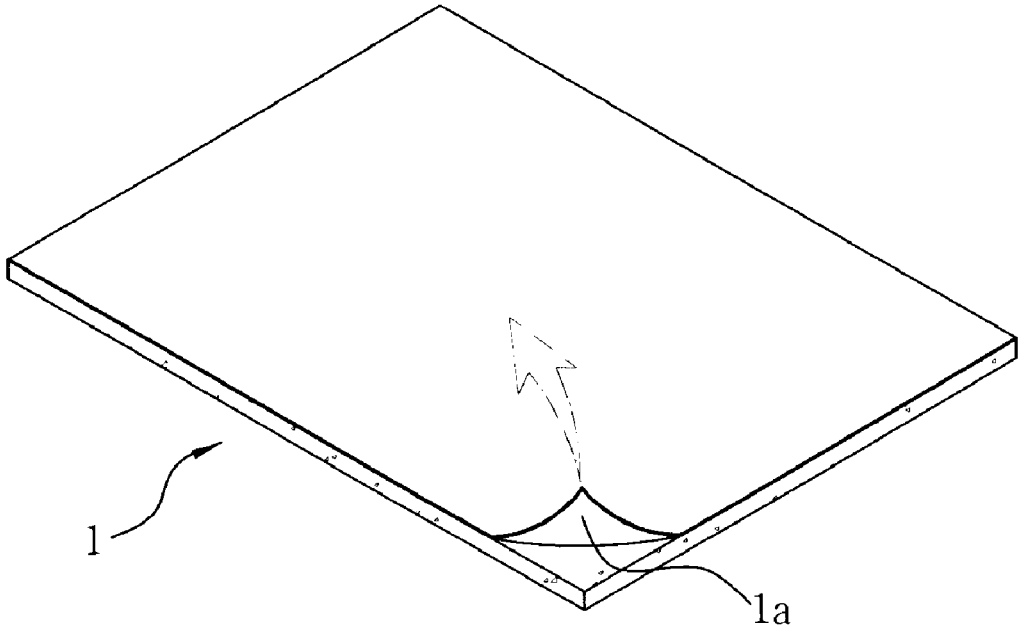
FIGS. 2A through 2E are views illustrating a process of manufacturing a typical engineered stone top plate.
Figure 2B:
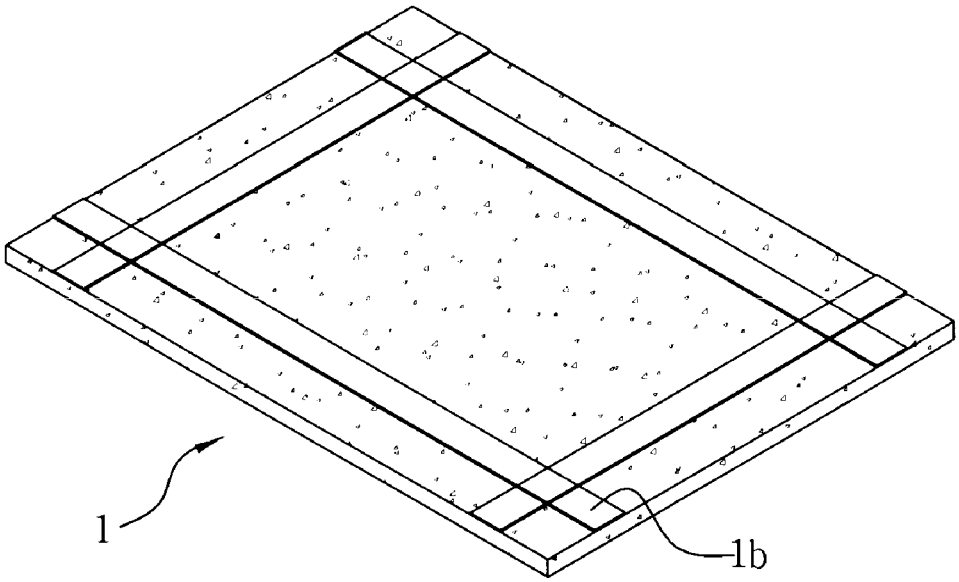
Figure 2C:
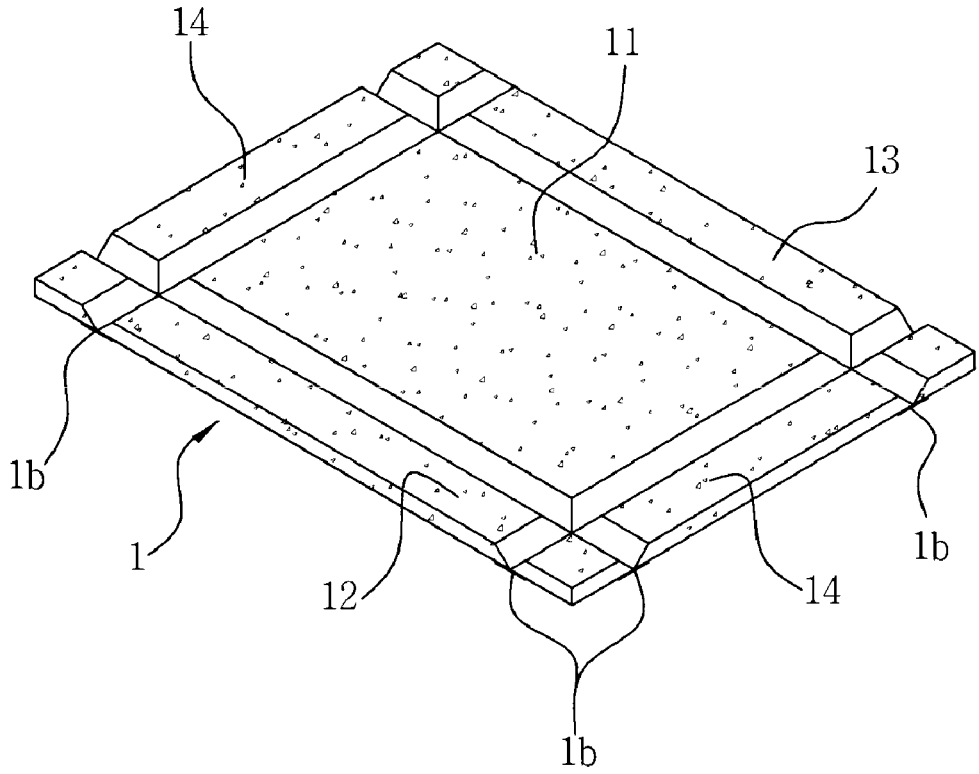
Figure 2D:
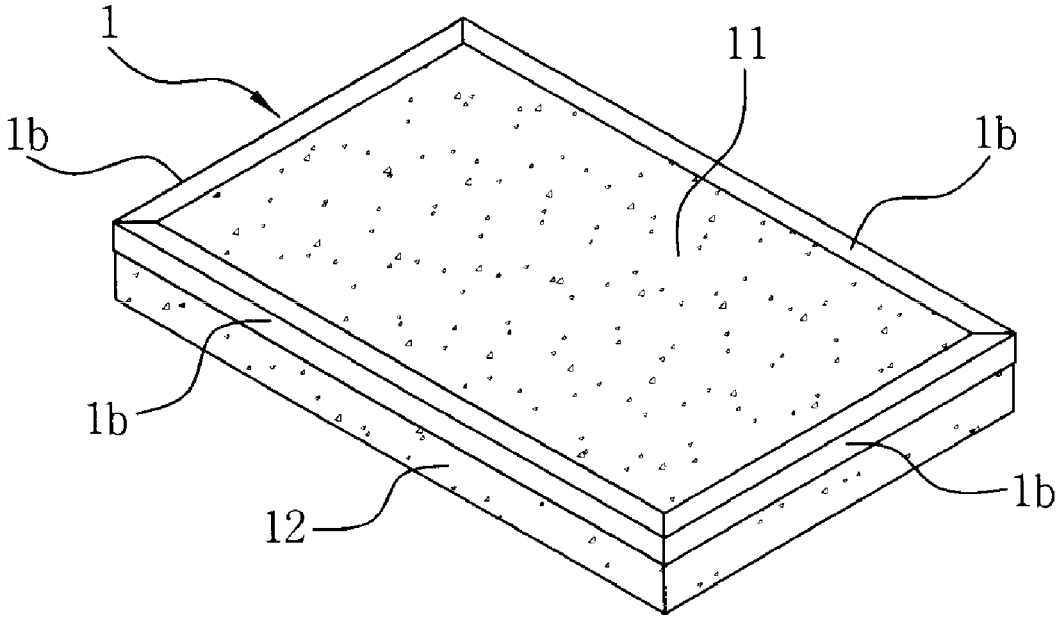
Figure 2E:
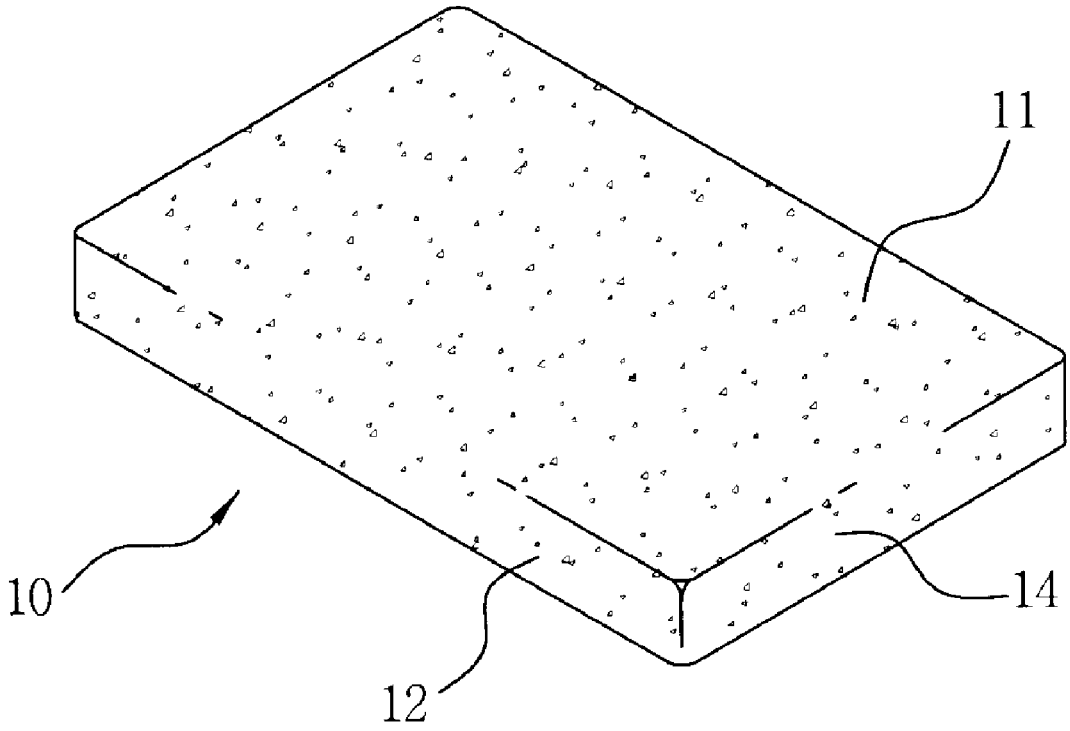

As shown in FIG. 3, a V-groove processing apparatus 100 may include a processing unit 200 for cutting an engineered stone raw plate (1 of FIG. 2A) and forming V-grooves inside cut surfaces, a transfer unit 300 for moving the processing unit 200 to cut the engineered stone raw plate 1 and form the V-grooves, and a surface plate unit 400 on which the engineered stone raw plate 1 to be cut and formed to have V-grooves is disposed.

Figure 4:
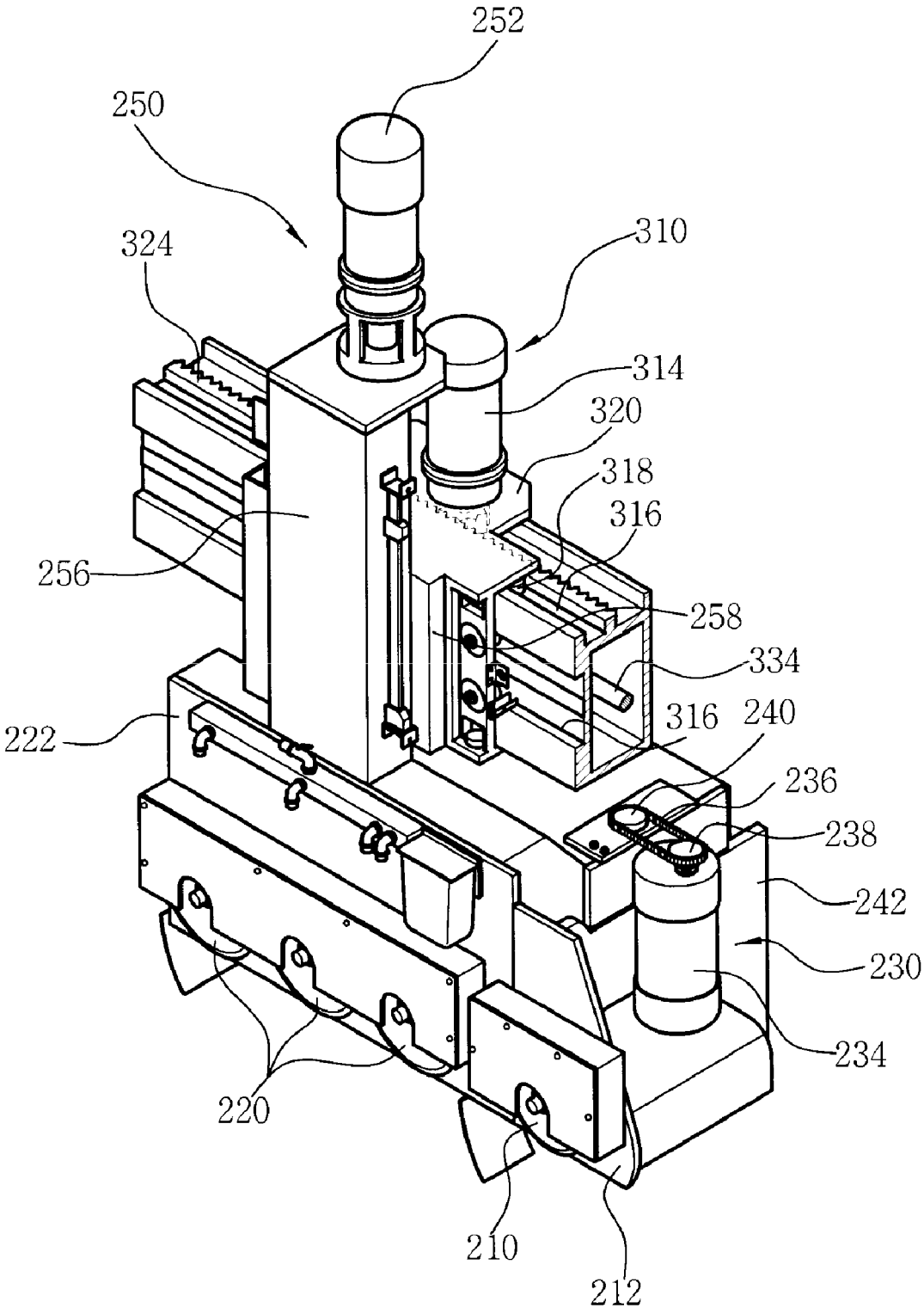
FIG. 4 is a front view illustrating a processing unit shown in FIG. 3.
Figure 5:
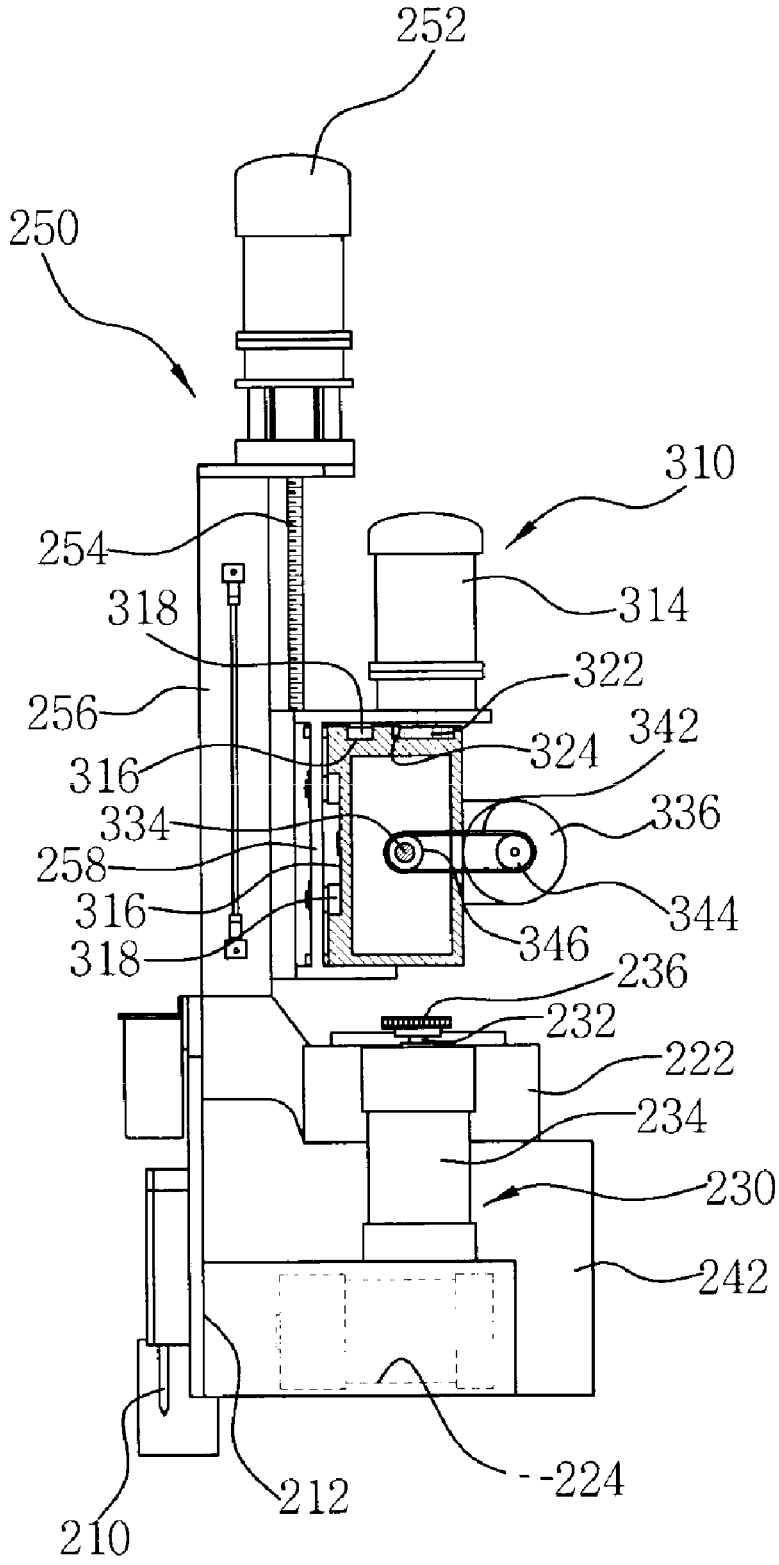
FIG. 5 is a side view illustrating the processing unit of FIG. 4.
Figure 6:
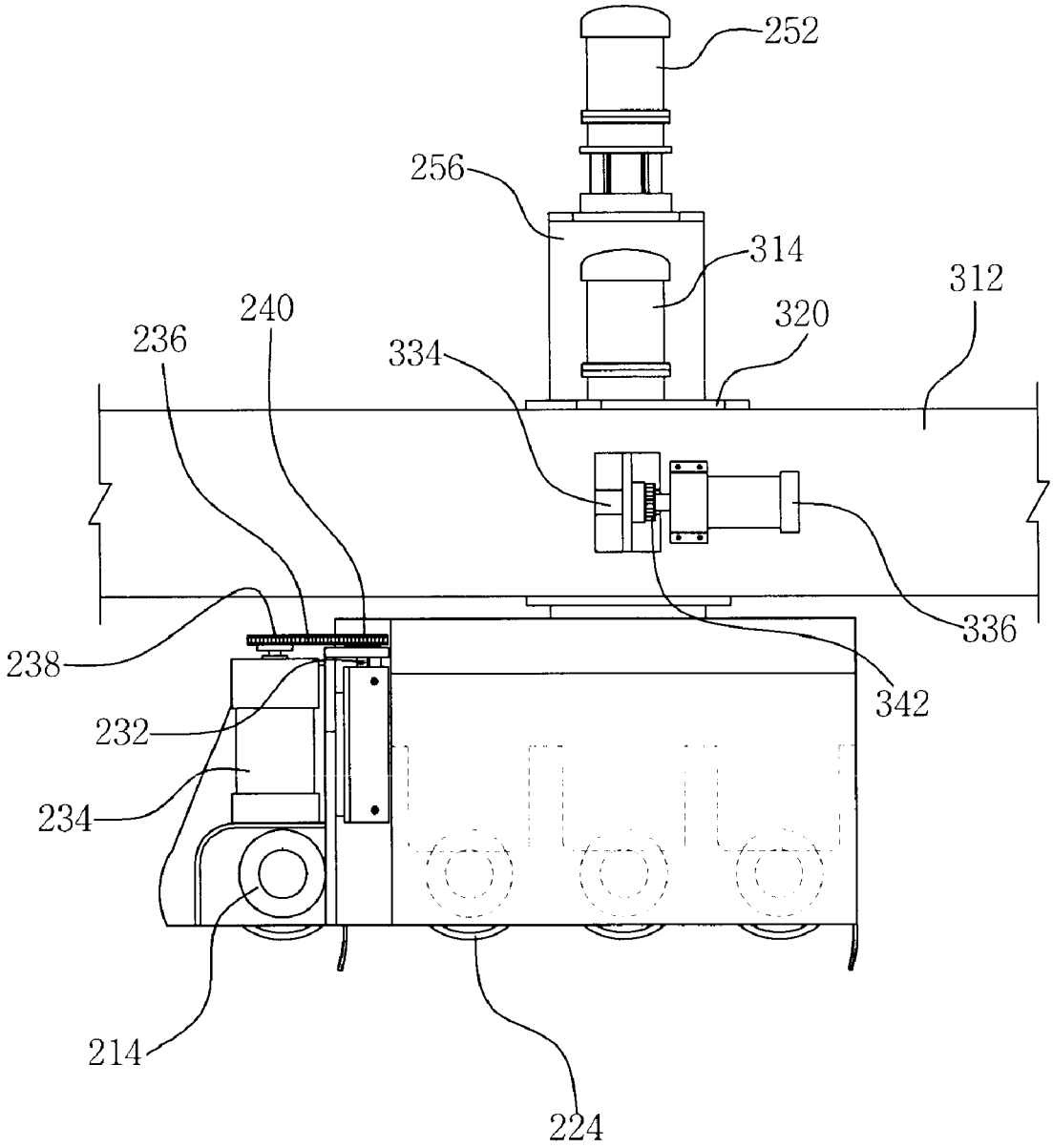
FIG. 6 is a rear view illustrating the processing unit of FIG. 4.

FIG. 4 is a front view illustrating the processing unit 200 shown in FIG. 3. FIG. 5 is a side view illustrating the processing unit 200 of FIG. 4. FIG. 6 is a rear view illustrating the processing unit 200 of FIG. 4.

Referring to FIGS. 4 through 6, the processing unit 200 may include a circular saw blade 210 for cutting the raw plate 1 and one or more V-groove cutters 220 for forming V-grooves inside the cut surfaces. The cutting of the raw plate 1 is performed by the circular saw blade. The formation of the V-grooves is performed by the circular saw blade 210 and the V-groove cutters 220 after the cutting of the raw plate 1.

As shown in the drawings, the circular saw blade 210 is disposed at the front side of a vertical cutting panel 212. The V-groove cutters 220 are disposed at the front side of a cutter housing having a box shape. The circular saw blade 210 is rotatably connected to a cutting motor 214 disposed on the rear surface of the cutting panel 212. The V-groove cutters 220 are rotatably connected to a V-groove forming motor 224 disposed in the cutter housing 222.

On the other hand, the processing unit 220 may further include a first rise and fall unit 230 for transferring the circular saw blade 210 to the cutting location of the raw plate 1 during the cutting of the raw plate 1 and restoring the circular saw blade 210 to the original place after the cutting of the raw plate 1, a second rise and fall unit 250 for transferring the circular raw blade 210 and the V-groove cutters 220 to the V-groove forming location of the raw plate 1 during the formation of the V-grooves and restoring the circular saw blade 210 and the V-groove cutters 220 after the formation of the V-grooves.

The first rise and fall unit 230 may include a first screw rod 232 and a first rise and fall motor 234. The first screw rod 232 is vertically disposed at one side of the cutting housing 222 adjacent to the cutting panel 212. The first rise and fall motor 234 is fixedly disposed at one side of the cutting housing 222 so as not to be interfered with the first screw rod 232 and the cutting panel 212. The first screw rod 232 and the first rise and fall motor 234 are connected to each other by a first chain 236. For this, a first sprocket 238 is mounted on the first screw rod 232, and a second sprocket 240 is mounted on the first rise and fall motor 234. The first rise and fall unit 230 further includes a first screw nut block 242 installed at one end of the cutting panel 212 adjacent to the first screw rod 232. The first screw nut block 242 is installed at one end of the cutting panel 212 to face one side of the cutter housing 222, and is penetrated by the first screw rod.

On the other hand, the second rise and fall unit 250 may include a second rise and fall motor 252 and a second screw rod 254. The second rise and fall motor 252 is disposed on a column 256 vertically extending from the cutter housing 222. One end of the screw rod 254 is connected to the second rise and fall motor 252, and the other end thereof connected to the upper portion of the cutter housing 222 along the column 256 that is vertical. A second screw nut block 258 is penetrated by the second screw rod 254, and is slidably connected to a transfer beam 312 of the transfer unit 300 described later.

The processing unit 200 is transferred by the transfer unit 300 in every direction of the V-groove processing apparatus 100.

Referring again to FIG. 3, the transfer unit 300 may include a first transfer unit 310 for transferring the processing unit 200 in a lateral (right and left) direction, and a second transfer unit 330 for transferring the processing unit and the first transfer unit 310 in a longitudinal (front and rear) direction, when viewing the front of the V-groove processing apparatus 100.

The first transfer unit 310 may include a transfer beam 312 and a first transfer motor 314 for transferring the second screw nut block 258 along the transfer beam 312. As shown in FIGS. 4 through 6, the transfer beam 312 has a hollow rectangular beam shape and extends to in the lateral direction. A guide groove 316 is formed in the front surface and the upper surface of the transfer beam 312 along the longitudinal direction of the transfer beam 312. A guide roller 318 mounted on the second screw nut block 258 is slidably inserted into the guide groove 316. The first transfer motor 314 is disposed on an extension panel 320 that horizontally extends from the upper surface of the second screw nut block 258 to the upper surface of the transfer beam 312. A first transfer pinion gear 322 is mounted in the first transfer motor 314. A first transfer rack gear 324 engaging with the first transfer pinion gear 322 is mounted on the upper surface of the transfer beam 312. The first transfer rack gear 324 extends along the longitudinal direction of the transfer beam 312 so as not to be interfered with the guide groove 316 formed in the upper surface of the transfer beam 312.

The second transfer unit 330 may include a pair of guide frames 322 on which both ends of the transfer beam 312 are slidably disposed, a transfer axis 334 disposed in the transfer beam 312 along the longitudinal direction of the transfer beam 312 and exposing out of the both ends of the transfer beam 312 at its both ends, a second transfer motor 336 rotating the transfer axis 334. As shown in the drawing, the pair of guide frames 332 has a certain height from the ground, and extends in the longitudinal direction. A second transfer rack gear 338 is mounted on the upper surface of the guide frame 332, extending along the longitudinal direction of the guide frame 332. Second transfer pinion gears 340 engaging with second transfer rack gears 338 are coupled to both ends of the transfer axis 334 exposed at the both ends of the transfer beam 312, respectively. In this case, the second transfer pinion gear 340 has an inverse U-shape, and is limited within a cover 348 mounted on the transfer beam 312 such that one end thereof is not interfered with the transfer axis 334. On the other hand, the second transfer motor 336 is disposed on the rear surface of the transfer beam 312. The second transfer motor 336 is connected to the transfer axis 334 by a second chain 342 penetrating the rear surface of the transfer beam 312. For this, the second transfer motor 336 is mounted with a third sprocket 344, and the transfer axis 334 is mounted with a fourth sprocket 346.

Figure 7:
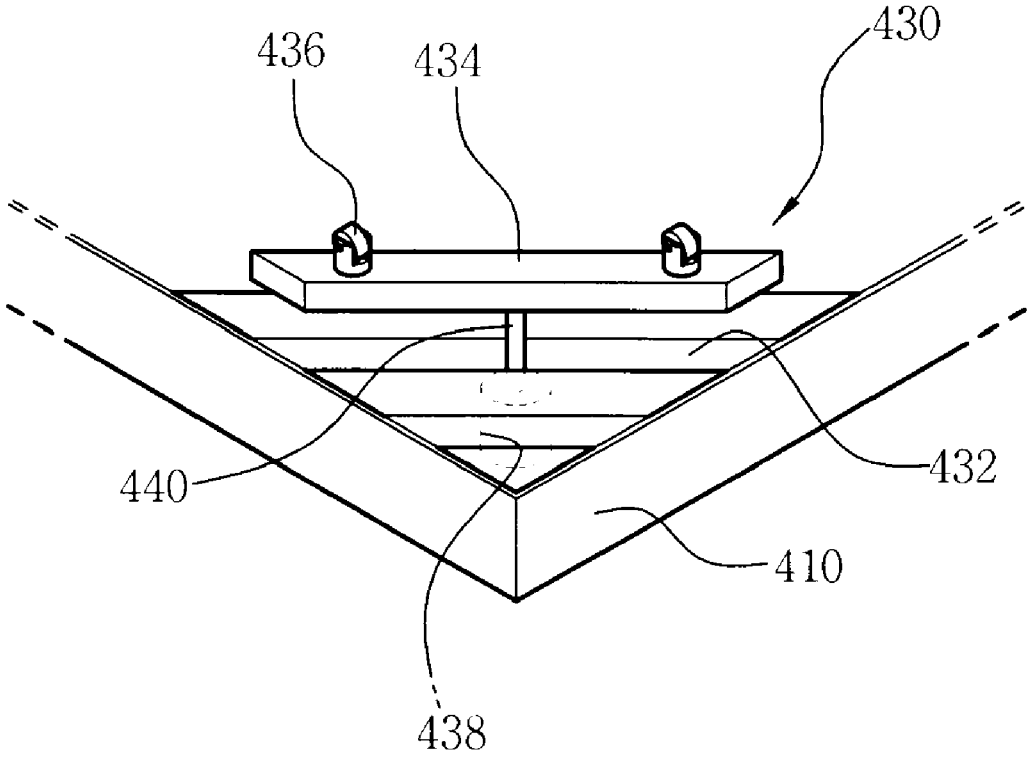
FIG. 7 is a perspective view illustrating a surface plate unit shown in FIG. 3.

FIG. 7 is a perspective view illustrating the surface plate unit 400 shown in FIG. 3.

Referring to FIGS. 3 and 7, the surface plate unit 400 may include a table 410 rotatably disposed on a base 412 between the pair of guide frames, and a fixing member 420 for fixing the engineered stone raw plate 1 on the table 410 during the cutting of the raw plate and the processing of V-grooves. The table 410 may be rotated by a typical motor (not shown) or a typical cylinder (not shown).

The fixing member 420 includes a fixing beam 422 and a pair of fixing cylinders 424 under the fixing beam 422. One end and the other end of the fixing beam 422, as shown in the drawing, are mounted on the end portion of the cover 348 mounted on both ends of the transfer beam 312 without an interference with the transfer beam 312. The pair of fixing cylinder 424 is disposed under both sides of the fixing beam 422 such that a fixing cylinder rod 426 can extend toward the raw plate 1 on the table 410.

On the other hand, a discharge member 430 is disposed movably from the inside of the table 410 to the upper side of the table 410. For this, a plurality of discharge guide grooves 432 are obliquely formed in the upper surface of the table 410 such that the discharge member 430 can be discharged. The discharge member 430 disposed in each discharge groove 432 includes a discharge panel 434 horizontally disposed in the discharge guide groove 432, and a discharge roller 436 disposed on the discharge panel 434. A discharge cylinder 438 is disposed under the discharge panel 434 to expose the discharge roller 436 in the upward direction of the discharge guide groove 432. A lower portion of the discharge cylinder 438 is fixed on the bottom of the discharge guide groove 432, and a discharge cylinder rod 440 extending from the discharge cylinder 438 is connected to a lower portion of the discharge panel 434. In other words, the discharge roller 436 is exposed to the discharge guide groove 432 during the discharge of the raw plate 1, and is limited within the discharge guide groove 432 during the cutting of the raw plate 1 and the formation of the V-grooves.

Hereinafter, a use condition of the V-groove processing apparatus 100 will be described in brief.

The raw plate 1 is put on the table 410 of the surface plate unit 400, and then the fixing cylinder 424 is operated such that an extending end portion of the fixing cylinder rod 426 presses an upper portion of the raw plate 1 to fix the raw plate 1 on the table 410. If the raw plate 1 is fixed on the table 410, one side of the raw plate 1 is cut, and a V-groove is processed in the inside of a cut surface. The cutting is performed by the circular saw blade 210 alone, and the V-groove processing is performed by the circular saw blade 210 having completed the cutting and the cutters 220.

For cutting of the raw plate 1, the cutting motor 214 and the first rise and fall motor 234 operate to descend the circular saw blade 210 to a cutting start position while rotating the circular saw blade 210. The first rise and fall motor 234 rotates the first screw rod 232 connected by the first chain 236. As the first screw rod 232 rotates, the cutting panel 212 and the circular saw blade 210 connected to the first screw rod 232 by the first screw nut block 242 descend. If the circular saw blade 210 moves to the cutting start position, the processing unit 200 moves to cut one side of the raw plate 1. The first transfer motor 314 is operated to move the processing unit 200. When the first transfer motor 314 operates, the first transfer pinion gear 322 connected to the first transfer motor 314 rotates and moves along the first transfer rack gear 324 engaged therewith. As a result, the processing unit 200 cuts the raw plate 1 while being guided in a longitudinal direction along the transfer beam 312. On the other hand, if the cutting is completed, the second transfer motor 314 and the first rise and fall motor 234 rotates in the opposite direction to restore the circular saw blade 210 and the processing unit 200 to the original place.

Thus, when the cutting is completed, the fixing cylinder rod 426 retracts to release the fixation of the raw plate 1, and the processing unit 200 moves into the inside of the cut surface to process V-grooves. The processing unit 200 moves into the inside of the cut surface by a value that is preset in a controller (not shown). The second transfer motor 336 is operated to move the processing unit 200 to the inside of the cut surface, that is, the V-groove processing location. When the second transfer motor 336 operate, the transfer axis 334 connected by the second chain 342 and the second transfer pinion gear 340 mounted on both ends of the transfer axis 334 rotate, and the second transfer pinion gear 340 that rotates moves along the second transfer rack gear 338 engaged therewith. Thus, the transfer beam 312 and the processing unit 200 move to the V-groove processing location.

As described above, when the processing unit 200 has moved to the V-groove processing location, the fixing cylinder rod 426 is again extended to fix the raw plate 1 on the table 410. The cutting motor 214, the V-groove forming motor 224, and the second rise and fall motor 252 operate to rotate the circular saw blade 210 and the cutters 220, and at the same time descend the circular saw blade 210 and the cutters 220 over the V-groove processing location. In this case, the second rise and fall motor 252 rotates the second screw rod 254. As the second screw rod 254 rotates, the circular saw blade 210 and the cutter 220 move to a V-groove processing start location. After the circular saw blade 210 and the cutters 220 move to the V-groove processing start location, the processing unit 200 again moves to process V-grooves inside the cut surface. In this case, the movement of the processing unit 200 for processing V-grooves may be performed similarly to that in the cutting of the raw plate 1. In other words, in order to move the processing unit 200 for the V-groove processing, the first transfer motor 314 operates to process V-grooves. On the other hand, the V-groove processing includes forming a groove at the V-groove processing location using the preceding circular saw blade 210 and forming a V-groove in the groove using the following cutters 220.

Thus, if one side of the raw plate 1 is cut, and a V-groove is formed inside the cut surface, the processing unit 200 returns to the original place. Then, cutting and V-groove processing are repetitively performed on another portion of the raw plate 1 through the same process.

On the other hand, in order to discharge the raw plate 1 having undergone the cutting and the V-groove processing for a next process, the fixing cylinder rod 426 retracts to release the fixation of the raw plate 1, and the discharge cylinder 438 operates to extend the discharge cylinder rod 440. When the discharge cylinder rod 440 extends, the discharge rollers 436 disposed on the discharge panel 434 raise the raw plate 1 to expose it over the discharge guide groove 432. When the discharge roller 436 raises and expose the raw plate over the discharge guide groove 432, the raw plate 1 is pushed to be discharged out of the processing apparatus 100.

Using the processing unit 200 having the circular saw blade 210 and the cutter 220, the V-groove processing apparatus 100 according to an embodiment of the present invention can cut the raw plate 1 and process V-grooves in the raw plate 1 in one apparatus.

As described above, a V-groove processing apparatus according to an embodiment of the present invention has an advantage of smoothly performing a V-groove processing in that both cutting of an raw plate and processing of V-grooves can be performed in one processing apparatus by including a circular saw blade for cutting an engineered stone raw plate at one side of cutters for forming V-grooves.

Also, since cutting and processing of a V-groove is performed in one processing apparatus, a heavy engineered stone raw plate need not to be moved from a cutter to the V-groove processing apparatus, and the location of the V-groove to be processed need not to be reset.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A V-groove processing apparatus for cutting and V-groove processing, comprising a processing unit for processing V-grooves in an engineered stone raw plate fixed on a table while being transferred by a transfer unit, wherein the processing unit comprises:

a circular saw blade disposed at a front of a cutting panel to cut the engineered stone raw plate;

one or more cutters disposed on a front of a cutter housing to form a V-groove inside a cut surface;

a first rise and fall unit transferring the circular saw blade to a cutting location during the cutting of the engineered stone raw plate and restoring the circular saw blade to an original place after the cutting of the engineered stone raw plate; and a second rise and fall unit transferring the circular saw blade and the cutters to a V-groove forming location during the formation of the V-groove and restoring the circular saw blade and the cutters to original places after the formation of the V-groove;

wherein the first rise and fall unit comprises:

a first screw rod vertically disposed at one side of the cutter housing adjacent to the cutting panel;

a first rise and fall motor fixedly disposed at one side of the cutter housing so as not to be interfered with the first screw rod and the cutting panel;

a first chain connecting the first screw rod and the first rise and fall motor; and a first screw nut block mounted on one end of the cutting panel adjacent to the first screw rod and penetrated by the first screw rod; and wherein the second rise and fall unit comprises:

a second rise and fall motor mounted on an upper portion of a column vertically extending from an upper surface of the cutter housing;

a second screw rod comprising one end thereof connected to the second rise and fall motor and the other end thereof connected to an upper portion of the cutter housing along the column; and a second screw block disposed at a rear side of the column and penetrated by the second screw rod.

2. The V-groove processing apparatus of claim 1, wherein the circular saw blade and the cutters are connected to a cutting motor at a rear side of the cutting panel and a V-groove forming motor at a rear side of the cutting housing to rotate.

3. The V-groove processing apparatus of claim 1, wherein the first screw rod and the first rise and fall motor are mounted with a first sprocket so as to be connected by the first chain, and the first rise and fall motor is mounted with a second sprocket.

* * * * *